US008770316B2

(12) United States Patent
Jelsma

(10) Patent No.: US 8,770,316 B2
(45) Date of Patent: Jul. 8, 2014

(54) METHOD AND APPARATUS FOR HIGH PRESSURE RADIAL PULSED JETTING OF LATERAL PASSAGES FROM VERTICAL TO HORIZONTAL WELLBORES

(75) Inventor: Henk H. Jelsma, Spring, TX (US)

(73) Assignee: Radial Drilling Services, Inc., Spring, TX (US)

( * ) Notice: Subject to any disclaimer, the term of this patent is extended or adjusted under 35 U.S.C. 154(b) by 347 days.

(21) Appl. No.: 12/454,515

(22) Filed: May 19, 2009

(65) Prior Publication Data

US 2009/0288884 A1 Nov. 26, 2009

Related U.S. Application Data

(60) Provisional application No. 61/128,254, filed on May 20, 2008.

(51) Int. Cl.
*E21B 7/18* (2006.01)

(52) U.S. Cl.
USPC ..... 175/67; 175/78; 166/117.6

(58) Field of Classification Search
USPC ..... 166/298, 301, 117.5, 117.6; 175/67, 99, 175/271, 73, 75, 77–81, 89, 90, 424
See application file for complete search history.

(56) References Cited

U.S. PATENT DOCUMENTS

| | | | | |
|---|---|---|---|---|
| 4,407,361 | A * | 10/1983 | Van Winkle | 166/85.1 |
| 4,497,381 | A | 2/1985 | Dickinson, III et al. | |
| 4,527,639 | A | 7/1985 | Dickinson, III et al. | |
| 4,640,362 | A | 2/1987 | Schellstede | |
| 4,765,173 | A | 8/1988 | Schellstede | |
| 4,787,465 | A | 11/1988 | Dickinson, III et al. | |
| 4,790,384 | A | 12/1988 | Schellstede et al. | |
| 4,880,067 | A | 11/1989 | Jelsma | |
| 4,928,767 | A | 5/1990 | Jelsma | |
| RE33,660 | E | 8/1991 | Jelsma | |
| 5,413,184 | A | 5/1995 | Landers | |
| 5,853,056 | A * | 12/1998 | Landers | 175/424 |
| 6,125,949 | A * | 10/2000 | Landers | 175/62 |
| 6,263,948 | B1 | 7/2001 | Whitley | |
| 6,668,948 | B2 | 12/2003 | Buckman, Sr. et al. | |
| 7,422,059 | B2 | 9/2008 | Jelsma | |
| 7,441,595 | B2 | 10/2008 | Jelsma | |
| 7,669,672 | B2 * | 3/2010 | Brunet et al. | 175/83 |
| 7,699,107 | B2 * | 4/2010 | Butler et al. | 166/308.1 |
| 2007/0181308 | A1 * | 8/2007 | Jelsma | 166/313 |

FOREIGN PATENT DOCUMENTS

GB WO2006/016137 * 2/2006

* cited by examiner

*Primary Examiner* — Shane Bomar
*Assistant Examiner* — Kipp Wallace
(74) *Attorney, Agent, or Firm* — Osha · Liang LLP

(57) ABSTRACT

An apparatus and system that permits radial passages and lateral passages to be jetted into surrounding subsurface formation from existing or new wells. The system employs a casing cutting component that positionable by an anchored indexing device downhole to permit the formation of accurately positioned openings in the well casing. The system employs a passage jetting component employing extreme high jet fluid pressures and a method that allows for the downhole manipulation of the components so that the radial and lateral passages are achieved by minimum pulling work on casing, tubing or other components. The system is fully controllable and reduces dramatically the margins of error and failure that are inherent of the present day systems used for radial drilling.

6 Claims, 2 Drawing Sheets

METHOD AND APPARATUS FOR HIGH PRESSURE RADIAL PULSED JETTING OF LATERAL PASSAGES FROM VERTICAL TO HORIZONTAL WELLBORES

Applicant hereby claims the benefit of U.S. Provisional Application Ser. No. 61/128,254 filed on May 20, 2008 by Henk H. Jelsma and entitled "Device to Allow High Pressure Radial Pulsed Jetting in Vertical to Horizontal Wells", which Provisional Application is incorporated herein by reference for all purposes.

BACKGROUND OF THE INVENTION

1. Field of the Invention

The present invention relates generally to drilling activities for petroleum production wells and to renovation activities for existing wells to enhance the production capability thereof. More specifically, the present invention concerns a method and apparatus for conveyed high pressure hydraulic radial pulsed jetting in vertical to horizontal boreholes for jet formation of specifically oriented lateral passages in a subsurface formation surrounding a wellbore.

2. Description of the Prior Art

Of particular interest to the present invention is the subject matter of U.S. Pat. No. 7,422,059, issued to Henk H. Jelsma on Sep. 9, 2008 and entitled Fluid Injection Stimulated Heavy Oil or Mineral Production System and U.S. Pat. No. 7,441,595, issued to Henk H. Jelsma on Oct. 28, 2008 and entitled "Method and Apparatus for Single-Run Formation of Lateral Passages From a Wellbore", which patents are incorporated herein by reference for all purposes.

The terms "lateral passages or lateral bores", as used herein, is employed to describe a plurality of lateral passages that extend laterally from a wellbore into a subsurface earth formation of interest. It is not intended that this term be restricted solely to a rotary boring or drilling operation. Rather, it is intended that the terms "lateral or radial bores" and "lateral or radial passages" be considered synonymous. The term "bore" is intended to encompass any method of forming a passage in an earth formation extending laterally or radially from a wellbore. For example, lateral or radial passages are presently formed in subsurface earth formation by hydraulic jet blasting, radial drilling, such as by using a drilling system powered by a hydraulic motor. The terms "lateral" or "radial" are intended to identify passages that extend laterally from a wellbore into an earth formation whether the lateral passages are oriented in normal relation with the wellbore or extend upwardly or downwardly or in inclined relation to their intersection with the wellbore. The wellbore or wellbore section from which the lateral passages extend may have a wide range of orientation or inclination, i.e., from vertical to horizontal without departing from the spirit and scope of the present invention.

In general, wells for the production of petroleum products are drilled substantially vertically from a point on the surface of the earth to a desired subsurface zone. In many cases however, it is not possible, desirable or practical to drill wells vertically, so the wells or sections of the wellbores are drilled so as to be inclined or deviated from the vertical. Wells may also be drilled with vertical segments from which deviated segments are drilled and in many cases the deviated segments terminate in substantially horizontal bore sections, especially when a producing formation is rather thin but extends a substantial distance from the point of intersection of the primary or main wellbore with the producing formation. Steerable drilling systems have been developed fairly recently to controllably deviate a wellbore so that it may intersect a subsurface anomaly that is perhaps laterally offset from the initial vertical orientation of the wellbore.

For the production of fluid, such as crude oil or minerals from wells intersecting subsurface production formations, the formation of multilateral passages from a main or principal typically vertical wellbore has been accomplished by rotary drilling or reaming as set forth in U.S. Pat. Nos. 4,880,067, 4,928,767 and RE. 33,660 of Jelsma, or by hydraulic jet blasting as set forth in U.S. Pat. Nos. 5,413,184, 5,853,056 and 6,125,949 of Landers and U.S. Pat. Nos. 6,263,948 and 6,668,948 of Buckman et al. Other related inventions from the standpoint of radial or lateral formation of passages extending from a primary well are presented by U.S. Pat. Nos. 4,497,381, 4,527,639 and 4,787,465 of Dickenson et al, U.S. Pat. Nos. 4,640,362, 4,765,173 and 4,790,384 of Schellstede et al. Later product and process development activity concerning or utilizing hydraulic jet lateral passage formation is presented in U.S. Pat. Nos. 7,422,059 and 7,441,595 of Henk H. Jelsma, identified above.

Other existing lateral passage forming products currently present in the marketplace include devices which contain solid steel strings to achieve vertical drilling using drill bits. These solid steel strings are used for the most part to form lateral passages from vertical wellbores. Steel tool positioning and operation strings are typically incapable of use in deviated sections of wellbores since they will not readily follow the contour of inclined wellbore sections.

A number of existing subsurface lateral passage forming tools that are presently found in the marketplace include drill strings using circulating fluids controlled from surface and provided through pumps. This is disadvantageous because of the excessive wear and high maintenance that occurs as very high jetting fluid medium pressures that are required to develop the necessary fluid pressure for jet blasting of lateral passages. For this reason drill strings are typically used only in conjunction with mechanical subsurface drilling apparatus for drilling lateral passages.

Some existing lateral passage forming products of the marketplace employ jetting systems that direct high pressure water at steady pressure to jet blast through formations to form lateral passages. This passage jetting process is typically rather slow, due to the steady fluid pressure that is employed. It has been determined that variable or pulsing jet blasting of lateral passages is more rapid and more efficient for lateral passage formation. However, it is detrimental to the jet blasting equipment, including coiled tubing or jointed tubing to develop high pressure pulsing pressure at the surface to yield the desired high pressure pulsing at the lateral passage depth of a wellbore. It is considered quite advantageous to develop pulsing high fluid pressure of jet blasting fluid in the downhole environment.

Other existing products found in the marketplace include devices which use abrasive fluids to cut a section of casing and penetrate laterally into the surrounding subsurface earth formation. The use of abrasives in jet blasting fluid is especially detrimental to the service life of surface based pumping equipment.

Currently existing lateral passage forming products found in the marketplace employ rotary mechanical drill systems to penetrate a subsurface formation by rotating drill heads. While such mechanical drilling systems can and have been employed, equipment and processes for drilling multiple lateral passages into a surrounding formation, without retrieving the drilling apparatus from the wellbore between each passage drilling operation, have not been used to date.

Presently existing products of the marketplace have been employed to penetrate the formation with hydraulic force at limited pressure and limited volumes. Such operations are quite slow and expensive in comparison with apparatus and methods for jet blasting lateral passages.

A problem with existing lateral passage forming products and techniques is that they have limited repeatability due to the uncertainty of actual penetration in more dense and compressive rock components. High pressure jet drills are unpredictable in their actual performance of jetting in the downhole environment due to the formation compressive factors that typically exist.

Another problem with existing lateral passage forming products and techniques is that they require multiple trips into a well to jet form a plurality of lateral passages into the formation, and for rotational orientation of a passage jetting mechanism within a wellbore so that the resulting lateral passages are oriented along predetermined azimuths.

A significant problem with existing lateral passage forming systems and techniques is that the use of abrasive materials in the passage jetting fluid is typically very damaging to the surface fluid pumping equipment and adversely affects the porosity and permeability of the producing formations and thus is detrimental to the productivity potential of the well. The use of basic fluids for lateral passage jetting activity can be very detrimental to the producing formation.

Another problem with existing products and techniques for forming lateral passages from a wellbore and into the surrounding subsurface formation is that they tend to become compressed and potentially damaged when vertical loads are applied as a result of space within the surrounding tubing.

It has also been determined that existing lateral passage forming products and techniques is that the small coiled tubing that is presently used with lateral passage forming systems has limited strength and pressure rating, thereby limiting the depth of operation as well as limiting the use of such equipment when higher angle application is desired.

SUMMARY OF THE INVENTION

It is the principle object of the present invention to provide a novel method and apparatus or device and system that facilitates application of radial jetting in deeper and highly deviated wells for multilateral passage formation in subsurface formations surrounding a wellbore.

It is another object of this invention to apply radial jetting lateral passage formation to wells having a wide range of wellbore angles, i.e., from vertical or other high angle up to horizontally oriented wells and be able to exit from a wellbore into the formation at various angles, ranging from vertical to 180 degrees and on multiple directions and levels.

It is also an object of this invention to provide for hydraulic jet formation of lateral passages from a wellbore in controlled and orientable fashion.

Another object of this invention is to allow a section of well casing to be cut or penetrated for the jetting of multiple lateral passages to be sequentially oriented without requiring pulling the casing penetrating system from the well between successive casing cutting activities.

It is an important object of this invention to provide a novel mechanism or tool and process for cutting multiple openings in well casing without necessitating retrieval of the cutting system between each casing cutting operation.

Another object of this invention is to allow the oriented laterals to be installed from a wellbore casing or open hole and in any size or depth.

A further object of this invention is the provision of a quick and efficient means to facilitate the jet formation of a plurality of lateral passages from a cased wellbore with a single tool movement into the wellbore.

Briefly, the various objects and features of the present invention are realized through the provision of a conveyed radial hydraulic fluid jetting system. The system has a casing cutting component to open the casing by cutting a section from the casing or forming holes in the casing. The system has a passage forming component allowing extreme high pressure continuous and/or pulsed conveyed passage jetting conduit supported by any type or size of coiled tubing to penetrate soft, medium and hard formations at any angle with no limit on lateral extension into the formation.

The casing cutting component or system and the lateral passage jetting system to be selectively set at a target depth within a well bore on a seating mechanism that is orientable and indexable. The seating mechanism accommodates a cutting system to make openings and/or open sections in the casing at the depth of interest in a single or multiple fashion. The seating mechanism also allows multiple lateral passages to be jetted from the opened or cut sections of the casing at any desired direction or angle from the main well bore. These features are achieved by the use of a casing cutting and jet passage forming system that includes a cutting mechanism and a jetting mechanism are each enclosed in a guide pipe to allow for high angle and high pressure application and controlled setting of the system. The system is rotationally positionable within a wellbore to permit directional changes in azimuth and angle of the jet formed lateral passages as desired.

The casing cutting and passage jetting system has a set of two main components that are each independently run into a wellbore. The first component is a casing cutting component and is composed of an outer conveyance body, a steel tube of selected length that is constructed such that it can accommodate the type of casing cutting components that are required.

The outer conveyance body has at its upper end a confining section that allows the lowering of the system by a retrieving ring incorporated into the body of an outer conveyance pipe. This ring is counteracted by a hydraulic latching mechanism that is partially retrievable and has two functions: 1) landing the system on an in-place oriented indexer system, and 2) allows for the "pushing" of the conveyance system into the well at high angles to ensure its proper seating into the indexer system. The confining section further allows for the required distance to cut openings or "windows" in the well casing. The outer conveyance body also includes a deflector tool section that is attached to its lower end and has an orienting section or component of the indexer and stinger mechanism for casing cutting tool orientation incorporated within it. This section remains connected to the outer body for the duration of the casing cutting operations. The casing cutting operations are accomplished sequentially, with rotational orientation being repeated for the number of openings that are desired, without any need for removing the conveyance body from the wellbore between each casing cutting operation.

The tool seating operation is achieved by a second ring into the conveyance outer body, below the retrieving ring. This ring has a greater internal diameter than the upper ring and will allow the hydraulic activated latching mechanism to pass through if required to pull through once the conveyance system is seated and allows this operation to be repeated as many times downhole as is required.

The cutting components are completed with a cutter, cardan type of shaft and a hydraulic or electric motor with sufficient torque rating to rotate and penetrate the casing body. This assembly is hung off from the coiled tubing of any applicable size and grade. The coiled tubing has the latch mechanism attached to it at the point of the retrieving and push rings section, and is opened up and seated into the rings when running into the hole till the depth of interest. At that depth the deflecting mechanism that is attached to the bottom of the coiled tubing seats and orients with commercially available orienting systems (Jelsma patents identified above). At this point the cutting assembly is several feet off the bottom of the wellbore to allow the unlatching hydraulically from the lower push ring and allows the motor to be lowered and start cutting. Upon completion of the casing cutting operation, the tool can be rotated or lifted to a new cutting location and additional casing cutting can be conducted, without necessitating retrieval of the casing cutting tool from the well between casing cutting cycles.

The cutting components are then retrieved by the coiled tubing being pulled back through the conveyance system until the hydraulic latch ring engages into the retrieving ring. At this point the entire conveyance system is pulled out of the indexer and brought to surface.

The second part of the conveyed radial hydraulic fluid jetting system is composed of: An outer conveyance body complete with a deflector extended to the required length of the lateral passages that are planned and the coiled tubing is completely retrieved from the body. A high pressure jet mechanism having multiple jetting holes is attached to a high pressure flexible hose of a lengths that is predetermined by the length of the lateral passages that are to be formed. This high pressure flexible hose is attached to a high pressure miniaturized pulse generator that is incorporated within the lateral passage jetting system. This system is then supported and positioned by the coiled tubing with the same retrieving/latch system as set forth above, allowing a longer run within the wellbore in direct relationship to the lateral passages that are planned.

The lateral passage jetting assembly is lowered and latched once again into the set indexer system that is secured, such as by packers or anchors at designed depth and position within the well bore. With the same manipulation of the coiled tubing, the flex hose with the pulse generator and jets is now seated, jetted with and rotated by means of the indexer to reenter the holes drilled in the casing or section cut in the casing. Once completed the system is retrieved and the indexer system recovered and the well is then ready to go back on production.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a sectional view of a conveyed casing cutting tool constructed according to the principles of the present invention and having an orienting deflector and stinger device.

FIG. 2 is a sectional view of a wireline set seat/orienting device that is set at a fixed position or depth within a wellbore or well casing by a casing anchor and provides an upwardly facing orienting profile and stinger receptacle for selective orienting engagement of the casing cutting tool of FIG. 1 therewith.

FIG. 3 is a sectional view taken along line 3-3 of FIG. 1.

FIG. 4 is a sectional view taken along line 44 of FIG. 1 showing a conveyed pulsed jet hydraulic jetting tool adapted with a lower orienting profile for oriented engagement with the wireline set seat/orienting device of FIG. 2 and having a deflector section oriented for registry with casing holes cut by the casing cutter tool of FIG. 1.

FIG. 5 is a plan view taken along line 4-4 of FIG. 3 and showing the hydraulic lock-in tool section of the conveyed pulsed jet hydraulic jetting tool of FIG. 3.

DETAILED DESCRIPTION OF PREFERRED EMBODIMENT

Figure 1:
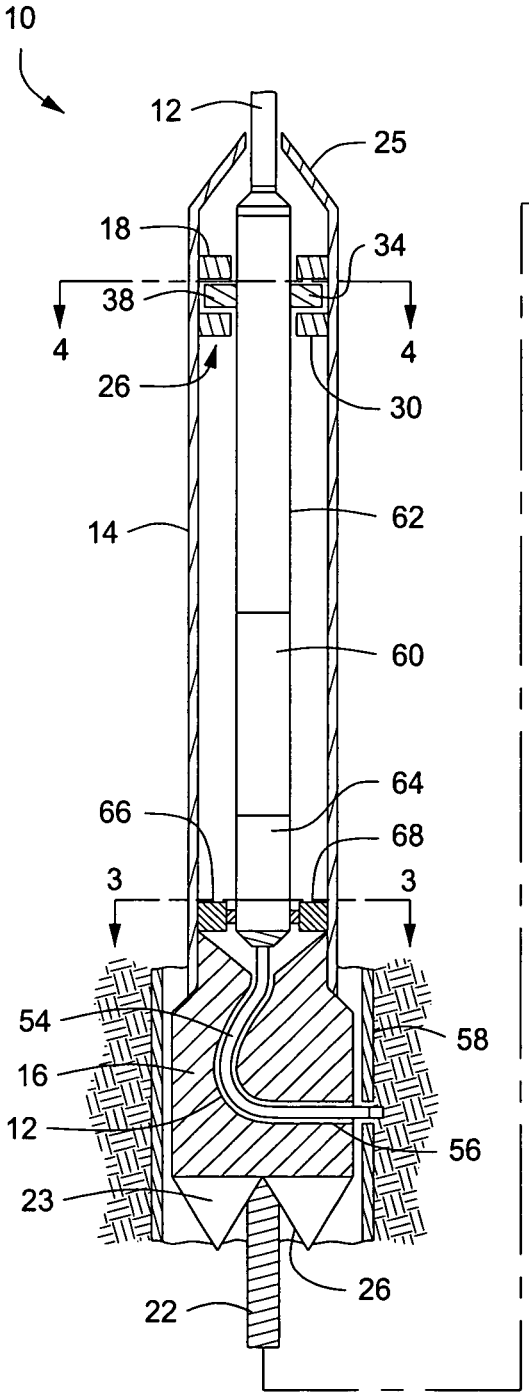
Figure 2:
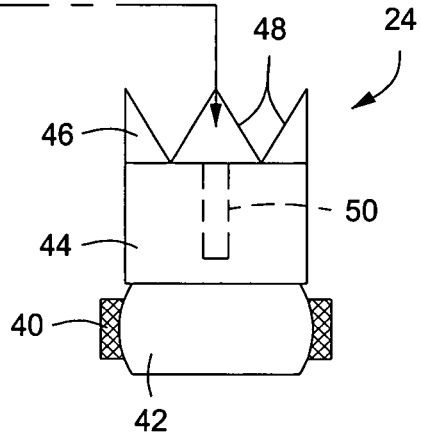

Referring now to the drawings and first to FIGS. 1 and 2, a casing cutting component of the present invention is shown generally at 10 and is conveyed into and from a wellbore by means of coiled tubing 12 that is controlled by coiled tubing handling equipment located at the surface. Alternatively, a tool conveyance string may be defined by multiple interconnected lengths of straight tubing without departing from the spirit and scope of the present invention. The casing cutting component or mechanism 10 has an outer tubular conveyance body 14, with a deflector or deflector shoe member 16 provided at its lower end. The outer tubular conveyance section can be constructed in several ways. It can be formed of commercially available production tubing and can have a size greater than the size of conventional coiled tubing or may be provided in the form of manufactured sections of tubes that are assembled to form a desired tubing string length. Internal components are preferably milled and inserted. The outer conveyance body can be constructed from high grade steel, stainless steel or aluminum or may be composed of a suitable polymer material such as Teflon® or any one of a number of suitable polymer materials.

The deflector shoe member 16 defines or has mounted thereto an indexing or orienting member 18 having a downwardly directed orienting profile 20 that substantially matches and is received in interfitting non-rotational relation with the upwardly directed profile of an orienting seat that is set within the casing. An elongate guiding member or "stinger" 22 projects downwardly from the deflector member 16 to establish proper rotationally indexed relation with a wireline set seat/orienting device shown generally at 24 in FIG. 2 and discussed in greater detail below. At its upper end the outer conveyance body 14 has a tapered or generally conical confining section 25 having a central opening through which the terminal end of a tubing string extends. It is important to note that the indexing or orienting member 18 at the lower extremity of the tubular conveyance body 14 is preferably rotationally adjustable relative to the deflector member 16 so that the position of casing openings may be precisely oriented to any desired azimuth with respect to a rotational orienting or indexing profile of the wireline set seat/orienting device 24. The deflecting shoe 16 may be constructed from aluminum, stainless steel, heavy plastic or a fluoropolymer such as Teflon®. Openings for circulation of drilling or completion fluid may be provided in the casing cutting component and may be completely open or may contain a "one way" valve to restrict the direction of fluid flow. The deflector shoe 16 may be connected to the production tubing or indexing tool by a threaded connection or may be bolted onto the tubing or tool if desired.

Figure 4:
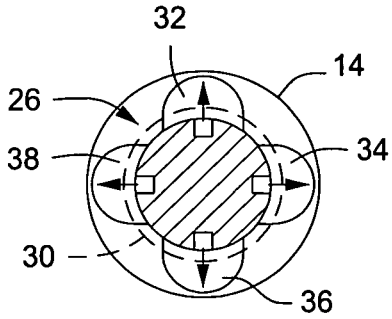

Within the outer tubular conveyance body 14 of the casing cutting component 10 is provided a hydraulic latching/retrieving mechanism shown generally at 26 in FIGS. 1 and 4. The latching/retrieving mechanism has an inner latch structure in the form of spaced latch plates 28 and 30 that are fixed within the outer tubular conveyance body 14. The linearly movable casing cutter drive component within the outer conveyance body is provided with a plurality of hydraulically extendable and retractable latch members 32, 34, 36 and 38 that are controllably movable between latched and released positions relative to the fixed latch plates. Lowering of the deflector and cutting or jetting assembly is done with the extendable and retractable latch members retracted to the release positions thereof. Cutting or jetting operations are each conducted with the extendable and retractable latch members fully retracted so that the casing cutting or passage jetting components will be free linear movement during operation thereof. The movable latch members are preferably hydraulically actuated by the pressure of fluid being supplied via the coiled tubing or any other type of tubing string. However, it should be borne in mind that the latch members may be actuated to the latched and released positions by any suitable means.

To initiate a casing cutting operation and a lateral passage jetting operation the wireline set seat/orienting device 24 is positioned within a wellbore at desired depth, typically by wireline tool running equipment and is set or secured in azimuth oriented position to control the location of casing openings and jetted lateral passages. The seat/orienting device 24 is set or secured within the casing or within an open hole wellbore by means of one or more casing anchor devices 40 that are supported by an anchor body 42. It should be borne in mind that the illustrations of the attached drawings are simplified to facilitate ready understanding of the present invention. For specifically detailed presentation of various mechanical aspects of the present invention, attention is directed to U.S. Pat. No. 7,441,595 of Jelsma which is incorporated herein by references as mentioned above. For example, the indexing mechanism and its anchoring system is shown at 74 in the '595 patent. Indexing rotation of the apparatus to successive designed positions within the wellbore is accomplished simply by increments of upward and downward linear movement to separate the engaged indexing profiles, rotate the casing cutting or passage jetting components to a desired position or azimuth and re-engaging the indexing profiles. An indexing control stinger is provided with a control slot arrangement which is traversed by a guide lug for rotational indexing control as set forth in column 9, lines 28-61 of the '595 patent. In vertical wellbore sections the rotational indexing is controlled simply by raising the casing cutting or lateral passage jetting mechanism and then lowering them into indexed engagement with the seat/orienting device 24. The coiled tubing or other tool handling equipment can also accomplish successive rotational indexing by pulling and pushing operations.

A seat orienting body 44 of the wireline set seat orienting is mounted to the anchor body 42 and has mounted thereto at its upper portion an indexing mechanism 46 having an upwardly facing indexing profile 48. The seat orienting body 44 also defines a stinger receptacle, shown in broken line at 50 which is oriented to receive the stinger member 22 shown at the lower portion of FIG. 1. The wireline set seat/orienting device 24 is controllably positioned within a wellbore or casing so that its indexing profile 48 has a desired rotational orientation so that casing holes and lateral passages will be rotationally oriented as desired. Both the casing cutting mechanism and the lateral passage jetting mechanism engage the specifically oriented indexing profile 48 and are rotationally oriented thereby to achieve proper positioning to form casing openings and jet formed passages that are precisely oriented with respect to predetermined azimuth.

Figure 3:
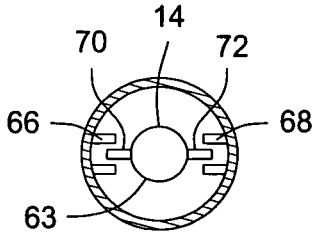

With further reference to FIGS. 1-3 the outer tubular conveyance body 14 can be of any desired length to accommodate the casing cutting or drilling equipment. The deflector shoe member 16 is fixed to the tubular conveyance body 14 and defines a guide passage 52 having a curved portion through which a flexible drive shaft is movable. The flexible drive shaft 54 is preferably of the cardan type, formed by interconnected rigid segments and is moved in guided relation through the curved guide passage 52 and being rotatable within the guide passage. The lower or exit portion 56 of the guide passage 52 is a laterally oriented substantially straight cutter guide passage section which functions to guide the terminal end of the shaft 54 laterally during casing cutting activity. The cutter guide passage section 56 may be oriented substantially horizontally or it may be inclined upwardly or downwardly to properly orient the casing opening that is formed in preparation for subsequent jet forming of a lateral passage having an intended lateral passage orientation. A metal cutting member 58, such as a milling cutter, drill or other suitable cutting device is mounted to the terminal end of the flexible shaft 54 and is rotated against the casing to mill or otherwise cut a desirably oriented lateral passage opening in the casing. As the flexible cutter drive shaft 54 is rotated, such as by means of a shaft rotating motor 60 of an elongate generally cylindrical drive member 62, the flexible cutter drive shaft 54 is moved linearly within the guide passage only sufficiently to engage the well casing and cut an opening through it. This shaft and cutter movement is preferably accomplished by downward movement of the elongate generally cylindrical drive member 62 within the outer housing 14. Alternatively, downward or forward movement of the cutter drive shaft and cutter member can be accomplished by the shaft rotating motor 60 and/or its pump 64. The shaft rotating motor 60 is preferably hydraulically actuated by fluid that is pumped through the coiled tubing 12. If desired, the motor operated pump 64 may actuate a cutter shaft drive mechanism that imparts linear movement to the cutter shaft during the casing cutter operation and feeds the cutter through the casing is the casing metal is cut away. The hydraulic fluid medium may be powered by fluid pumped through the coiled tubing 12 as indicated above or may be supplied within the casing if desired. Alternatively, the rotary shaft drive motor 60 can be operated electrically, such as by battery power of a battery system within the drive member 62 or by any other suitable power system if desired.

As shown at the lower portion of FIG. 1 and in the transverse sectional view of FIG. 3, spaced pairs of guide and positioning members 66 and 68 are fixed within the tubular conveyance body 14. Guide members 70 and 72 are mounted externally of the elongate generally cylindrical internal drive member 62 and are received in the guide or positioning space between the pairs of guide and positioning members 66 and 68 to maintain the proper operational position of the internal drive member 62 within the tubular conveyance body 14 for performance of the casing cutting operation and to permit the limited linear movement of the internal drive member as is required for a casing opening cutting operation.

In the performance of a casing cutting operation, the elongate generally cylindrical internal drive member 62 is run into the wellbore and is landed with the indexing profile 20 of its indexing or orienting member 18 in oriented engagement with the indexing profile 48 of the wireline set seat/orienting device 44 of the casing anchor. With the indexing or orienting member 18 rotationally adjusted as desired the metal cutting device 58 will be properly positioned for precise cutting of an opening of designed position and azimuth orientation. The drive motor 64 is then actuated to drive the flexible cardan type shaft 54 and move it through the guide passage 52-56 a sufficient distance for cutting an opening completely through the casing. If multiple casing openings are desired, the elongate generally cylindrical internal drive member 62 is raised to retract the casing cutter device within its guide passage section 56. The casing cutting mechanism or component 10 is then raised by applying a lifting force to the coiled tubing to disengage the indexing profiles 20 and 48. The tubular conveyance body 14 is then rotated to a desired position by the linear and rotational cycling operation of the Jelsma '595 patent and is then lowered to re-engage the indexing profiles 20 and 40 at a different, pre-selected rotational position. Rotational positioning of the tubular conveyance body 14 and conducting a metal cutting operation can be conducted multiple times to form a desired number of casing openings according to a lateral passage design for the individual well without retrieving the apparatus from the well between each metal cutting operation. This feature materially saves time and costs as compared with casing cutting and lateral passage jetting processes that are currently available.

It should be borne in mind that rotational positioning of the tubular conveyance body 14 is preferably accomplished according to the teachings of U.S. Pat. No. 7,441,595 of Jelsma. The guide stinger 22 is preferably of the type shown at 90 in FIGS. 3 and 8 of the Jelsma '595 patent so that sequential rotational positioning of the tubular conveyance body 14 can be achieved simply by lifting it for indexing slot controlled rotational indexing and then lowering it to re-engage the indexing profiles, with a metal cutting operation being conducted at each re-engaged position. This feature provides for accurate and efficient location of the casing openings without requiring precise rotational control from the surface. After the desired number of casing openings have been cut, the tubular conveyance body 14 is retrieved from the wellbore by surface manipulation of the coiled tubing 12 or any other conveyance system that might be employed.

Figure 5:
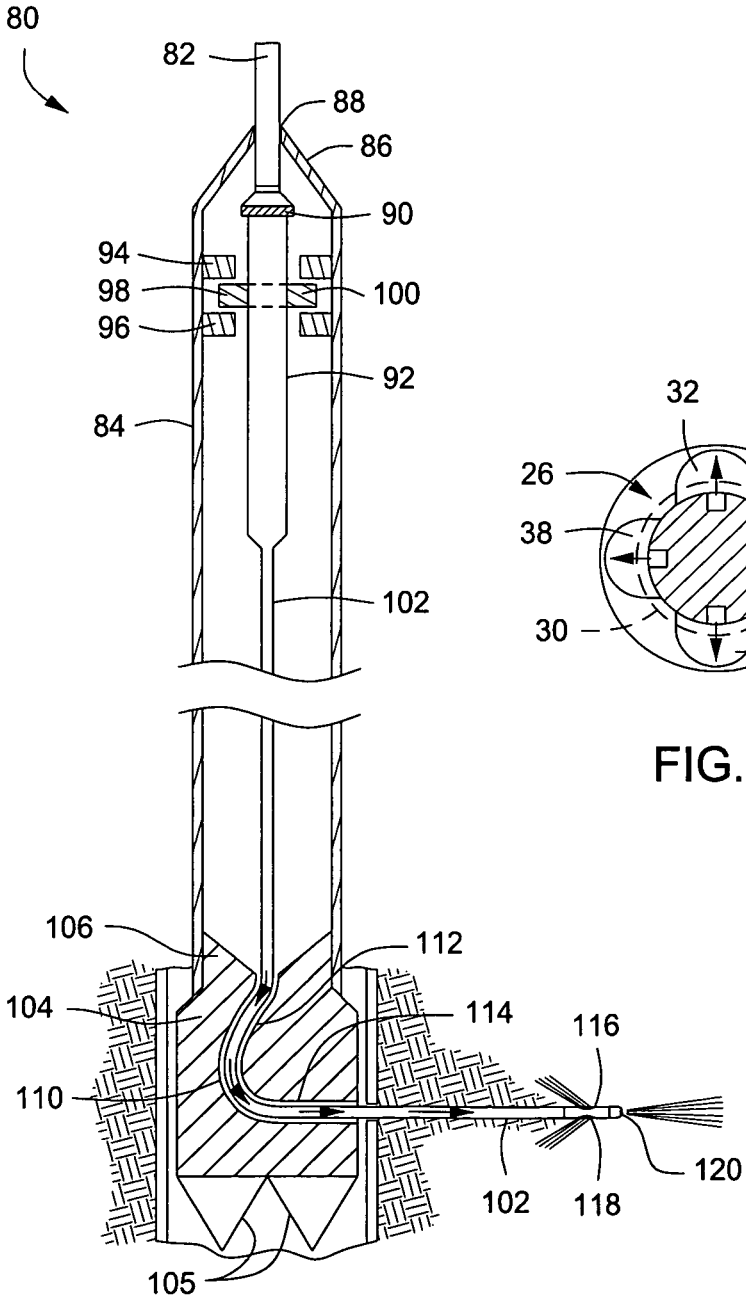

For multiple lateral passage jetting activity from the wellbore a lateral passage jetting component or mechanism shown generally at 80 in FIG. 5 is run into the wellbore on coiled tubing 82 of any desired size. The lateral passage jetting mechanism 80 provides for high pressure jet formation of a desired number of lateral passages corresponding to the number and orientation of the casing openings that were formed by the casing cutting system of FIGS. 1-4. To enable lateral passage jetting it should be borne in mind that the wireline set seat/orienting device 24 will have remained set and oriented within the wellbore during retrieval of the casing cutting system. It will be released from its set position by wireline equipment after the lateral passage jetting operation has been completed. The lateral passage jetting system 80 will be run into the wellbore and will be seated on and oriented by the wireline set seat/orienting device 24.

The lateral passage jetting system of FIG. 5 comprises an outer tubular body 84 having an upper tapered confining section 86 forming a central opening 88 within which the lower end portion of the coiled tubing is located. A tube coupling member 90 is employed to establish connection of the lower end of the coiled tubing with the upper end portion of a pulse generator 92 having a retriever mechanism permitting the entire lateral passage jetting component 80 to be retrieved from the wellbore by pulling force being applied via the coiled tubing 82. The pulse generator is selectively latched within the outer conveyance body 84 by a latch mechanism that may be substantially identical to the latch mechanism shown in FIG. 1. The lateral passage jetting system 80 is run into the wellbore on coiled tubing with the pulse generator latched and substantially immovable within the outer tubular conveyance body or housing 84 as shown in FIG. 5. The pulse generator latching mechanism incorporates a pair of latch plates 94 and 96 that are fixed in spaced relation within the outer conveyance body 84. The pulse generator 92 is provided with hydraulically actuated extendable and retractable latch members 98 and 100 that are retracted to permit downward linear movement of the pulse generator within the conveyance housing 84. The pulse generator is designed to receive passage jetting fluid from the coiled tubing 82 or in the alternative may receive the jetting fluid from the annulus between the coiled tubing and casing. Preferably the pulse generator 92 is designed to be powered hydraulically by the jetting fluid being and achieves amplification of the inlet fluid pressure to develop a very high discharge pressure and converts the pressure to a pulsating condition that more quickly and efficiently erodes the surrounding formation material to develop lateral passages. These lateral passages significantly stimulate the production of oil, gas and other formation fluids from the formation without necessitating the expense of conducting formation fracturing and propping or providing other formation treatment activities.

A high pressure flexible hose 102 is mounted in fluid communication with and extends downwardly from the pulse generator 92 and is of a length permitting its lateral deflection and its extension to a desired lateral distance into the surrounding subsurface formation. For example, the length of the high pressure flexible hose may be from about 50 feet or less to about 300 feet or more, depending on the design that is intended and the character of the formation in which the lateral passages are to be formed. Consequently, the length of the outer conveyance body 84 must be sufficient to permit complete retraction of the flexible hose within the outer conveyance body and full extension of the flexible hose into the formation during lateral passage jetting operations. For this reason the outer conveyance body 84 will have a length greater than 300 feet if the lateral passages are designed to be 300 feet in length. Depending on the orientation of the wellbore at formation depth, i.e., vertical or inclined, the lateral passages may extend from the wellbore horizontally, or may be inclined upwardly or downwardly into the formation surrounding the wellbore.

At the lower end portion of the outer conveyance body 84 a deflector shoe 104 is mounted to the outer conveyance body by threaded connection, bolted connection or any other suitable means. The deflector shoe defines an upper guide section 106 having tapered guide surfaces 108 that guide the high pressure flexible hose 102 into a hose guide passage 110. The hose guide passage has an upper curved portion 112 and a lateral hose and nozzle orienting guide section 114 which is preferably substantially straight and is oriented substantially horizontally as shown in FIG. 5 or is inclined upwardly or downwardly according to the intended orientation of the lateral passages that are to be formed by the lateral passage jetting operation. The deflector shoe 104 is provided with a downwardly facing indexing profile 105 which corresponds to the configuration of the upwardly facing indexing profile of the hydraulic latching/retrieving mechanism 26. This feature permits the lateral passage jetting system or component 80 to be positioned within the wellbore by the hydraulic latching/retrieving mechanism 26 in the same manner as the casing cutting component is positioned. The downwardly facing indexing profile 105 is preferably rotationally adjustable so that the lateral hose and nozzle orienting guide section 114 can be precisely rotationally oriented according to the lateral passage orientation that is desired.

At the lower terminal end of the high pressure flexible hose 102 is provided a jet nozzle 116 having rearwardly oriented jet openings 118 and at least one forwardly directed passage blasting opening 120. The rearwardly oriented jet openings 118 provide a reaction force during jetting operations for traction propulsion of the jet nozzle flexible hose to pull them into a lateral passage being jet formed and also serve to flush formation debris from the lateral passage. The forwardly directed blasting opening 120 serves to direct a high pressure pulsating jet of a jet blasting fluid medium against the formation material, hydraulically blasting away the material and forming the lateral passage. The jet nozzle 116 may be rotatably mounted to the high pressure flexible hose 102 so that its jet fluid energized rotation, together with pulsation of the high pressure jet fluid, will cause substantially straight tracking of the jet nozzle as the formation is eroded by jet blasting. As set forth in the Jelsma '595 patent, the jet nozzle 116 may be adapted to tow a liner into place within the lateral passage during the passage blasting or jetting operation to minimize the potential for passage collapse after jet formation of the lateral passages has been completed. Alternatively, the lateral passages that have been formed may be subsequently lined with a perforated liner after the lateral passage jetting or blasting operation has been completed.

As mentioned above, it is considered disadvantageous to provide pumping equipment at the surface and to pump high pressure jetting fluid into a tubing string or a coiled tubing string for jet formation of lateral passages. This disadvantage has been overcome by providing a pulse generator 92 which is essentially located very near the subsurface formation where multiple lateral passages are to be jet formed. Preferably the pulse generator is hydraulically powered by jet fluid being supplied from the surface though the coiled tubing or within the well casing under average pump pressure. The pulse generator increases or amplifies the jet fluid pressure and develops jet fluid pressure pulses. The very high jet fluid pressure pulses exit the jet nozzle 116-120 and essentially shock the formation material causing rapid erosion of a lateral passage into the formation, the length of the lateral passage being determined by the length of the high pressure flexible hose 102 and by the condition of the formation material. The jet nozzle is of a length and character to ensure that the resulting lateral passage is substantially straight and is oriented as determined by the orientation of the substantially straight lateral portion 114 of the hose guide passage 110.

The process or method for lateral passage formation is accomplished by running the lateral passage jetting system 80 into the wellbore. In the event the section of the wellbore for location of the lateral passages is inclined, the lateral passage jetting system 80 is easily "pushed" through the inclined wellbore section by applying a pushing force to the coiled tubing or perhaps also by pumping assistance to ensure indexed seating engagement of the lateral passage jetting system 80 with the indexing profile 48 of the indexing mechanism 46 of the seat orienting body 44. The lateral passage jetting system 80 is landed with its indexing profile 105 in indexed engagement with the upwardly facing indexing profile 48 of the seat orienting body 44 of FIG. 2. During running of the lateral passage jetting system 80 the latch members 98 and 100 will be extending to their latched positions, securing the lateral passage jetting system substantially immovably at its retracted position within the outer tubular conveyance body 84. After the outer tubular conveyance body is landed on or engaged with the seat/orienting device 24, with the indexing profiles 48 and 105 engaged, the latch mechanism is actuated to its released condition, thus freeing the pulse generator and flexible hose for linear movement within the outer tubular conveyance body. The pulse generator 92 is then activated by pumping of jetting fluid medium through the coiled tubing from the surface. The high pressure pulsating jetting fluid is conducted from the pulse generator, through the high pressure flexible hose 1-2 and is ejected from the jet openings 118 and 120 of the jet nozzle 116. The jets of fluid from the jet nozzle openings 118 develop a resultant force pulling the jet nozzle and high pressure hose through a casing opening and into the surrounding formation. A first lateral passage is then jet formed in the formation as indicted above. As passage jetting continues and the formation material is eroded or blasted away, the flexible hose will be moved through the guide passage of the deflector shoe 104 and the pulse generator will be moved toward the deflector shoe. Passage jetting activity will continue until the pulse generator comes into contact with the deflector shoe and the high pressure flexible hose has been extended to its full length within the surrounding formation. The high pressure flexible hose is then retracted to its starting position by applying a lifting or pulling force on the coiled tubing and moving the pulse generator 92 upwardly to the latched position shown in FIG. 5.

At this point, assuming additional lateral passages are to be jet formed into the surrounding formation, the lateral passage jetting system 80 will be lifted or otherwise moved away from the indexing profile 48. As this retraction movement takes place the lateral passage jetting system 80 is rotated to another predetermined rotationally indexed position by the multiple position indexing mechanism and method that is set forth is U.S. Pat. No. 7,441,595 of Jelsma. This automated rotational indexing will position the deflector shoe 104 so that the jet nozzle 116 is disposed in aligned registry with another lateral passage opening of the casing. Jet forming or blasting of an additional lateral passage is then performed from this rotationally indexed position of the deflector shoe 104 as indicated above. Subsequently, the method or process described above will be repeated for each additional lateral passage as designed. It is not necessary to retrieve the lateral passage jetting system 80 from the wellbore until all of the lateral passages have been jet formed or blasted. After the last lateral passage has been completed and the high pressure flexible hose has been retracted into the deflector shoe 104 the latch mechanism is then re-engaged and a pulling force can then be applied to retrieve the lateral passage jet forming apparatus from the wellbore.

To complete the casing cutting and lateral passage jet forming operation, wireline equipment will then be employed to release the seat/orienting device 24 from the casing and to retrieve it to the surface.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. Apparatus for jet forming a plurality of lateral passages extending from a casing lined wellbore into the surrounding formation, comprising:

an indexing mechanism defining an anchor body and having casing anchor devices being secured at a desired location and selected rotational azimuth orientation within a well casing and defining a first indexing profile having upwardly facing angulated indexing surfaces defining a plurality of rotational indexing positions, said indexing mechanism having a seat orienting body supporting said first indexing profile and defining a stinger receptacle;

a casing cutting mechanism having a tubular conveyance body and a deflector shoe mounted to said tubular conveyance body and defining a second indexing profile having a plurality of downwardly facing angulated indexing profile surfaces being positionable in selectively rotationally indexed and non-rotatable relation with said first indexing profile when said casing cutting mechanism is moved into seated relation with said first indexing profile;

a stinger member projecting downwardly from said casing cutting mechanism and guiding said casing cutting mechanism into oriented non-rotatable relation with said first indexing profile and engaging within said stinger receptacle;

a deflector shoe being mounted to said tubular conveyance body, said deflector shoe defining a shaft guide passage and a laterally oriented shaft guide passage exit opening and support and orienting said second indexing profile for indexing engagement with said first indexing profile;

an internal drive member being supported within said tubular conveyance body and having a rotary motor and a motor operated pump;

a flexible drive shaft being rotated by said rotary motor and being located within said shaft guide passage for rotary and linear movement;

coiled tubing extending from the surface through the well casing and having fluid supplying and conveying connection with said internal drive member and supplying fluid to said motor operated pump;

a cutter device being mounted to said flexible drive shaft and cutting an opening in the well casing upon motor operated rotation of said flexible drive shaft and lateral advancing movement of said flexible drive shaft and cutter device from said deflector shoe; and a latch mechanism having a first latch component within said tubular conveyance body and a second latch component mounted to said internal drive member, said latch mechanism being hydraulically actuatable to release said second latch component from said first latch component and permit said linear movement of said internal drive member within tubular conveyance body, said latch mechanism being hydraulically actuated to a latched condition permitting retrieval of said casing cutting mechanism from the well casing.

2. The apparatus of claim 1, comprising:

said internal drive member and said flexible drive shaft being sufficiently linearly moveable within said tubular conveyance body and said shaft guide passage for moving said cutter device through said guide passage exit opening and through the well casing during cutting of a lateral passage opening in the well casing.

3. The apparatus of claim 1, comprising:

a lateral passage jet forming mechanism being run into the well casing on coiled tubing independently of said casing cutting mechanism and having a second tubular conveyance body;

a deflecting and hose guide shoe being mounted to said tubular conveyance body and defining a hose guide passage having a portion thereof oriented laterally, said deflecting and hose guide shoe defining a hose exit opening being oriented in registry with a casing opining being previously cut by said casing cutting mechanism;

a third indexing mechanism being mounted to said deflecting and hose guide shoe and defining a third indexing profile being oriented for rotary position indexing engagement with said first indexing profile and positioning said hose exit opening in registry with a previously cut casing opening;

a pulse generator being located within said tubular conveyance body and having a tubing connector and being connected in fluid communicating relation with said coiled tubing, said pulse generator receiving lateral passage jetting fluid from said coiled tubing and developing a pulsating output of high pressure lateral passage jetting fluid;

a high pressure flexible hose being in fluid communication with said pulse generator and extending through said tubular conveyance body and within said hose guide passage and being movable during jet forming of a lateral passage into the surrounding formation; and a jet nozzle being mounted to said high pressure flexible hose and being movable through a lateral passage opening of the casing and into the surrounding formation as a pulsing jet of high pressure fluid erodes the formation material.

4. The apparatus of claim 3, comprising: said pulse generator being sufficiently linearly moveable within said tubular conveyance body to extend substantially the complete length of said high pressure flexible hose into the surrounding formation.

5. The apparatus of claim 3, comprising:

a first latch component being mounted within said tubular conveyance body; and a second latch component being mounted to said pulse generator and being hydraulically actuatable to a latched position securing said pulse generator against movement within said tubular conveyance body and permitting running and retrieval of said lateral passage jet forming mechanism into and from the well casing and a release position releasing said pulse generator from said tubular conveyance body and permitting lateral passage jetting movement of said pulse generator and said high pressure flexible hose within said tubular conveyance body.

6. Apparatus for jet forming a plurality of lateral passages extending from a casing lined wellbore into the surrounding formation, comprising:

an indexing mechanism defining an anchor body and having casing anchor devices being secured at a desired location and selected rotational azimuth orientation within a well casing and defining a first indexing profile having upwardly facing angulated indexing surfaces defining a plurality of rotational indexing positions, said indexing mechanism having a seat orienting body supporting said first indexing profile and defining a stinger receptacle;

a casing cutting mechanism having a tubular conveyance body and a deflector shoe mounted to said tubular conveyance body and defining a second indexing profile having a plurality of downwardly facing angulated indexing profile surfaces being positionable in selectively rotationally indexed and non-rotatable relation with said first indexing profile when said casing cutting mechanism is moved into seated relation with said first indexing profile;

a stinger member projecting downwardly from said casing cutting mechanism and guiding said casing cutting mechanism into oriented non-rotatable relation with said first indexing profile and engaging within said stinger receptacle;

a deflector shoe being mounted to said tubular conveyance body, said deflector shoe defining a shaft guide passage and a laterally oriented shaft guide passage exit opening and support and orienting said second indexing profile for indexing engagement with said first indexing profile;

an internal drive member being supported within said tubular conveyance body and having a rotary motor and a motor operated pump;

a flexible drive shaft being rotated by said rotary motor and being located within said shaft guide passage for rotary and linear movement;

coiled tubing extending from the surface through the well casing and having fluid supplying and conveying connection with said internal drive member and supplying fluid to said motor operated pump;

a cutter device being mounted to said flexible drive shaft and cutting an opening in the well casing upon motor operated rotation of said flexible drive shaft and lateral advancing movement of said flexible drive shaft and cutter device from said deflector shoe;

a lateral passage jet forming mechanism being run into the well casing on coiled tubing independently of said casing cutting mechanism and having a second tubular conveyance body;

a deflecting and hose guide shoe being mounted to said tubular conveyance body and defining a hose guide passage having a portion thereof oriented laterally, said deflecting and hose guide shoe defining a hose exit opening being oriented in registry with a casing opining being previously cut by said casing cutting mechanism;

a third indexing mechanism being mounted to said deflecting and hose guide shoe and defining a third indexing profile being oriented for rotary position indexing engagement with said first indexing profile and positioning said hose exit opening in registry with a previously cut casing opening;

a pulse generator being located within said tubular conveyance body and having a tubing connector and being connected in fluid communicating relation with said coiled tubing, said pulse generator receiving lateral passage jetting fluid from said coiled tubing and developing a pulsating output of high pressure lateral passage jetting fluid;

a high pressure flexible hose being in fluid communication with said pulse generator and extending through said tubular conveyance body and within said hose guide passage and being movable during jet forming of a lateral passage into the surrounding formation;

a jet nozzle being mounted to said high pressure flexible hose and being movable through a lateral passage opening of the casing and into the surrounding formation as a pulsing jet of high pressure fluid erodes the formation material;

a first latch component being mounted within said tubular conveyance body; and a second latch component being mounted to said pulse generator and being hydraulically actuatable to a latched position securing said pulse generator against movement within said tubular conveyance body and permitting running and retrieval of said lateral passage jet forming mechanism into and from the well casing and a release position releasing said pulse generator from said tubular conveyance body and permitting lateral passage jetting movement of said pulse generator and said high pressure flexible hose within said tubular conveyance body.

* * * * *